United States Patent [19]

Bronnert

[11] Patent Number: 5,052,474

[45] Date of Patent: Oct. 1, 1991

[54] HANGER ASSEMBLY FOR A MULTIPLE TUBE HEAT EXCHANGER

[76] Inventor: Hervé X. Bronnert, 21495 Partridge Ct., Brookfield, Wis. 53005

[21] Appl. No.: 602,470

[22] Filed: Oct. 24, 1990

[51] Int. Cl.[5] ..... F28F 9/00; F28D 7/06

[52] U.S. Cl. ..... 165/67; 165/162; 248/68.1

[58] Field of Search ..... 165/67, 68, 162; 248/59, 62, 68.1

[56] References Cited

U.S. PATENT DOCUMENTS

| | | | |
|---|---|---|---|
| 1,274,504 | 8/1918 | Bowen | 165/162 |
| 2,016,470 | 10/1935 | White | 248/68.1 |
| 2,198,529 | 4/1940 | Fields | 165/162 |
| 2,560,845 | 7/1951 | Carpenter et al. | 248/68.1 |
| 2,586,001 | 2/1952 | Carpenter et al. | 248/68.1 |
| 2,835,478 | 5/1958 | Bemish | 165/67 |
| 2,975,998 | 3/1961 | Clift | 248/68.1 |
| 2,999,661 | 9/1961 | Shuter | 248/62 |
| 3,180,406 | 4/1965 | Oechslin | 165/162 |
| 3,506,227 | 4/1970 | Jenkins | 248/59 |
| 4,450,902 | 5/1984 | Bosne | 165/67 |

FOREIGN PATENT DOCUMENTS

| | | | |
|---|---|---|---|
| 1211232 | 2/1966 | Fed. Rep. of Germany | 165/162 |

*Primary Examiner*—Stephen M. Hepperle
*Assistant Examiner*—L. R. Leo
*Attorney, Agent, or Firm*—Foley & Lardner

[57] ABSTRACT

A hanger assembly for securing a hairpin type heat exchanger to a frame having cross members, the heater exchangers including an upper leg supported on the cross members and the lower leg supported on the upper leg by the hanger assembly, the hanger assembly including a U-shaped rod mounted on the upper leg and a plate supported by the U-shaped rod under the lower leg, the U-shaped rod including a notch to form an end section at each end of the rod, the end sections being bent at the notches to hold the plate in engagement with the lower leg.

4 Claims, 2 Drawing Sheets

HANGER ASSEMBLY FOR A MULTIPLE TUBE HEAT EXCHANGER

FIELD OF THE INVENTION

The present invention relates, generally, to a support system for minimizing the time for assembling a multiple tube type heat exchange module and a method having the same aim. The present invention more particularly relates to an inverted U-shaped hanger for positioning and supporting the legs of the heat exchanger on the frame of a multiple tube heat exchange module.

BACKGROUND OF THE INVENTION

Multiple tube heat exchange modules used for heating or cooling food products must meet rigid sanitary requirements. At the present time, the heat exchangers which form the modules are generally mounted on a frame by supporting the upper legs of the heat exchanger tubes on the cross members of the frame. Some of the lower legs are supported by a pair of plates located above and below the legs. The plates are interconnected by threaded rods which pass through the plates and are secured thereto by nuts and washers. This type of assembly procedure is both time consuming and costly. It is further difficult to clean the modules to meet sanitary requirements due to the cracks and crevices which are formed in the threads, nuts and washers in this type of support assembly.

SUMMARY OF THE PRESENT INVENTION

The present invention advantageously provides an improved support system for minimizing the time of assembly and cleaning of multiple tube heat exchange modules. The present invention advantageously provides such a system and method for its implementation, which overcomes many of the problems peculiar to prior art support systems and cleaning techniques.

The foregoing, and other advantages, are realized in one aspect of the present invention in a method for assembling the heat exchange module, comprising the steps of cutting a rod to a desired length, notching the rod near each end, bending the rod to form a U-shaped hanger, hanging the rod on the upper leg of the U-shaped heat exchange tubes, mounting a plate on the ends of the rod beneath the immediately adjacent lower leg of the heat exchanger, and bending the ends of the legs below the notches to a 45° angle to seat the plate against the bottom of the lower leg of the heat exchanger. Most preferably, the final assembly is self locking, is unaffected by vibration, and is sanitary.

In a preferred embodiment, the system comprises a hanger rod and a plate, the hanger rod is bent to form a U-shape and is notched near the ends to define a deformable end section at each end of the rod. The plate is provided with two holes for mounting on the hanger rod and is retained thereon by merely bending the end sections of the rod at the notches, the angle of the bend providing for adjustment of the height of the plate and as a consequence, a snug fit with the bottom of the lower leg. In addition to being simple and cost effective to manufacture, the hanger system can be used in multiple applications where sanitary requirements must be met.

Other principal features and advantages of the invention will become apparent to those skilled in the art upon review of the following drawings, the detailed description and the appended claims.

DETAILED DESCRIPTION OF THE DRAWINGS

Figure 1:
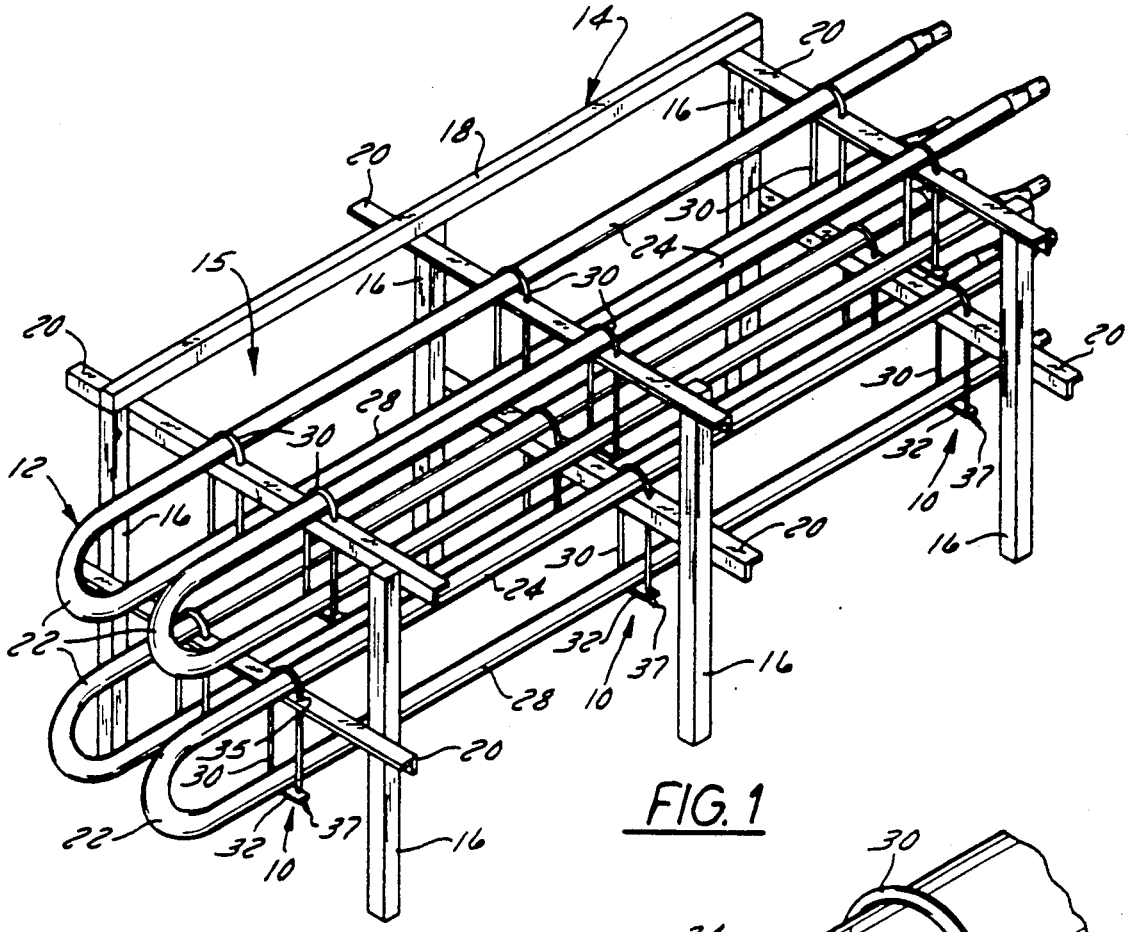
FIG. 1 is a perspective view of a portion of a multiple tube heat exchange module showing the inverted "U" shaped hanger assemblies according to the invention.
Figure 3:
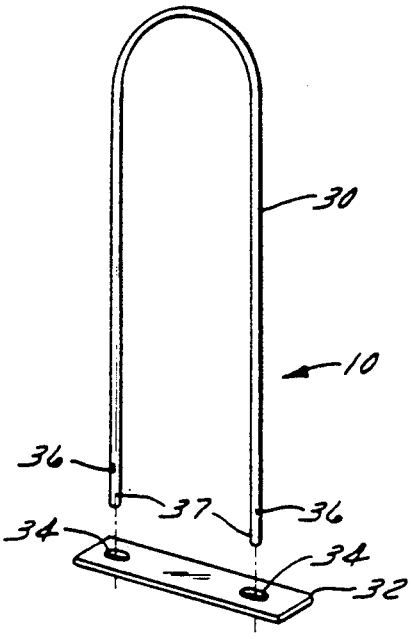
FIG. 3 is an exploded perspective view of the hanger assembly.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purposes of description and should not be regarded as limiting.

DETAILED DESCRIPTION OF THE PREFERRED EMBODIMENTS

The present invention relates, generally, to a hanger assembly 10 for supporting a heat exchanger 12 on a frame 14 and a method for mounting the heat exchanger on the frame 14. The present invention more particularly relates to an inverted "U" type hanger assembly 10 for supporting the tubes 22 of the heat exchangers 12. Accordingly, the invention will now be described with reference to the preferred hanger assembly used for assembling a multiple tube heat exchanger module.

Figure 2:
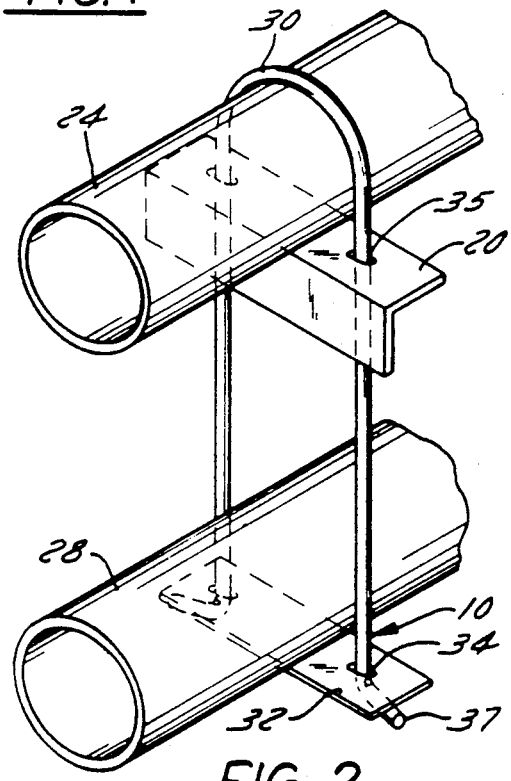
FIG. 2 is a perspective view of an inverted "U" shaped hanger assembly according to the invention.
Figure 4:
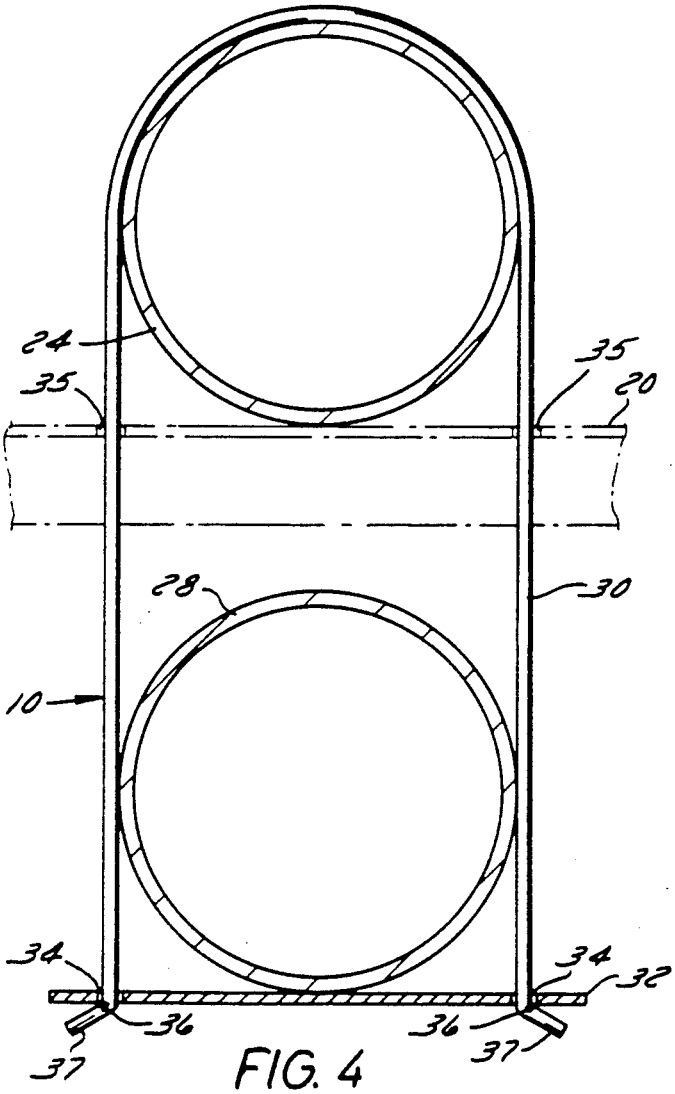
FIG. 4 is a cross-sectional view of one of the heat exchangers according to the invention.
Figure 5:
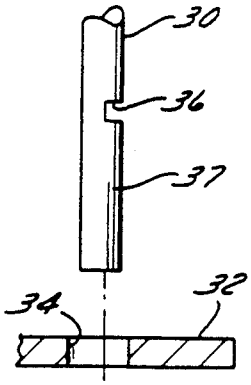
FIG. 5 is a view of one end of the hanger rod shown aligned with the opening in the hanger bracket plate.

Referring to FIG. 1 of the drawings, a multiple tube heat exchanger module 15 is shown which includes a frame 14 having vertical legs 16, elongate stringers 18 and angle iron type cross members 20. A number of hairpin shaped heat exchange tubes 22 are supported on the cross members 20 which support the upper legs 24 in each loop of the heat exchange tubes 22. The lower legs 28 are supported by the hanger assemblies 10 as shown in FIGS. 2 and 4.

Figure 6:
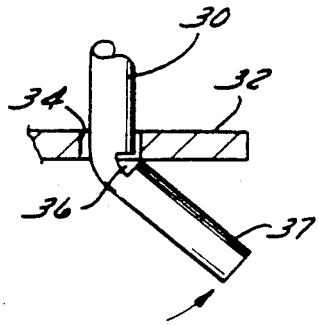
FIG. 6 is a view similar to FIG. 5, showing the end section of the hanger rod bent at a 45° angle to the plate.
Figure 7:
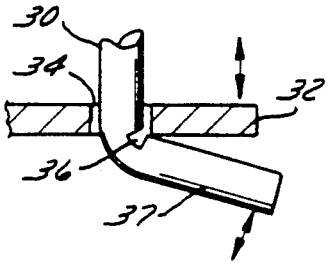
FIG. 7 is a view similar to FIG. 6, showing the end section of the rod bent at an angle greater than 45° to raise the plate.

In this regard, each of the hanger assemblies 10 includes a "U" shaped hanger 30 and a support plate 32. The support plate 32 includes a pair of openings or holes 34 spaced apart a distance substantially equal to the diameter of the tubes 22. The hanger 30 is formed from a rod cut to a length of approximately fourteen inches. A notch 36 is cut in each end of the rod approximately one inch from the end of the rod to define an end section 37 at each end of the rod. The rod is bent in the middle to form a "U" shape having a radius of curvature corresponding to the radius of the tubes 22. The rod is mounted on one of the upper legs 24 and extends downwardly through holes 35 in cross member 20. The upper portion of the rod positions and holds the upper legs 24 in a fixed position on the cross member 20. One end section 37 of the rod is bent to close the notch with the end section located at an angle of 45° from the axis of the rod as shown in FIG. 6. One of the holes 34 in plate 32 is aligned with the bent end section 37 of the rod which is inserted through the hole 34 in the plate 32. The other end section 37 of the rod is inserted through the hole 34 in the other end of the plate 32. The other end section 37 of the rod is then bent at an angle of 45° to lock the plate 32 on the rod as shown in FIGS. 2 and 4. The end sections 37 of the rod can be bent upward, as shown in FIG. 7, to close the notch and raise the plate 32 into engagement with the bottom of the lower leg 28.

The method contemplated herein for making the hanger comprises the steps of cutting a rod to a desired length; notching the rod at each end; bending the rod to a U-shape, bending one end of the rod to a 45° angle outwardly from the other end of the rod, mounting the rod on the upper leg of a multiple tube heat exchanger, mounting one end of a supporting plate on the bent end of the rod, mounting the other end of the plate on the other end of the rod, and bending the other end of the rod to an angle sufficient to seat the plate on the bottom of the lower leg of the heat exchanger.

Figure 8:
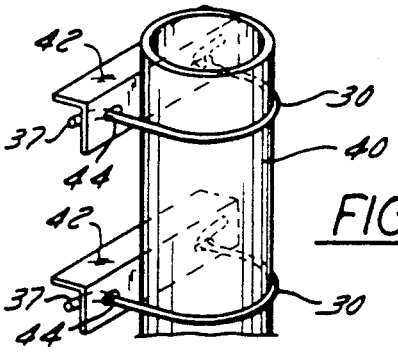
FIG. 8 is a view of the hanger rod used to support a standpipe.

In an alternate embodiment of the invention, shown in FIG. 8, the U-shaped rod 30 can be used to secure a standpipe 40 to cross members 42. The end sections 37 of the rods are inserted through holes 44 in the cross members 42. The end sections 37 are then bent at the notches to lock the standpipe 40 to the cross members 42.

Thus, it should be apparent that there has been provided in accordance with the present invention a hanger assembly for a multiple tube heat exchanger that fully satisfies the aims and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A hanger assembly for a multiple tube heat exchange module, the module including a frame having cross members and a number of hair pin shaped heat exchangers having upper and lower legs, the upper legs being supported on the cross members, said assembly comprising:

a "U" shaped rod supported on the upper leg of the heat exchanger, said rod including a notch to form an end section at each end of the rod, and a plate having a pair of holes, said end sections being aligned in the holes of said plate with the plate located in a position to engage the bottom of the lower leg of the heat exchanger, the end sections of the rod being bent at the notches at an angle to hold the plate in engagement with the lower leg of the heat exchanger.

2. The assembly according to claim 1, wherein said notches are located on the outside of the U-shaped rod.

3. The assembly according to claim 1 wherein the cross members include a hole on each side of said upper legs and said rod is aligned in said holes to position the upper legs on the cross members.

4. The assembly according to claim 1 wherein said end sections are bent in opposite directions to raise the plate into engagement with said lower leg.

* * * * *